US010697326B2

(12) United States Patent
Taxacher et al.

(10) Patent No.: US 10,697,326 B2
(45) Date of Patent: Jun. 30, 2020

(54) TURBINE COMPONENT ASSEMBLY

(71) Applicant: GENERAL ELECTRIC COMPANY, Schenectady, NY (US)

(72) Inventors: Glenn Curtis Taxacher, Simpsonville, SC (US); John McConnell Delvaux, Fountain Inn, SC (US); Matthew Troy Hafner, Honea Path, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 420 days.

(21) Appl. No.: 15/624,142

(22) Filed: Jun. 15, 2017

(65) Prior Publication Data

US 2018/0363510 A1 Dec. 20, 2018

(51) Int. Cl.

| | |
|---|---|
| ***F01D 25/28*** | (2006.01) |
| ***F23R 3/00*** | (2006.01) |
| ***F23R 3/60*** | (2006.01) |
| ***F01D 9/04*** | (2006.01) |
| ***F01D 11/08*** | (2006.01) |

(52) U.S. Cl.

CPC ..... *F01D 25/28* (2013.01); *F01D 9/04* (2013.01); *F01D 9/042* (2013.01); *F01D 11/08* (2013.01); *F23R 3/007* (2013.01); *F23R 3/60* (2013.01); *F05D 2240/35* (2013.01); *F05D 2260/38* (2013.01); *F05D 2260/52* (2013.01); *F05D 2300/10* (2013.01); *F05D 2300/6033* (2013.01); *F05D 2300/611* (2013.01); *F23R 2900/00005* (2013.01); *F23R 2900/00017* (2013.01)

(58) Field of Classification Search

CPC ..... F05D 2260/52; F05D 2300/10; F05D 2300/6033; F01D 5/284; F01D 9/04; F01D 25/28; F23R 3/007; F23R 3/60

See application file for complete search history.

(56) References Cited

U.S. PATENT DOCUMENTS

| | | | | |
|---|---|---|---|---|
| 6,315,519 | B1 | 11/2001 | Bagepalli et al. | |
| 6,758,653 | B2 | 7/2004 | Morrison | |
| 7,249,462 | B2 * | 7/2007 | Aumont | F01D 9/023 415/209.3 |
| 8,167,546 | B2 | 5/2012 | Shi et al. | |
| 8,834,106 | B2 * | 9/2014 | Luczak | F01D 11/12 415/173.3 |
| 2009/0115141 | A1 | 5/2009 | Simmons | |
| 2016/0123172 | A1 * | 5/2016 | Mondal | F01D 11/025 415/136 |

* cited by examiner

*Primary Examiner* — Arun Goyal

(74) *Attorney, Agent, or Firm* — McNees Wallace & Nurick LLC

(57) ABSTRACT

A turbine component assembly is disclosed, including a first component, a second component, and a cantilever spring. The first component is arranged to be disposed adjacent to a hot gas path, and includes a ceramic matrix composite composition. The second component is adjacent to the first component and arranged to be disposed distal from the hot gas path across the first component. The cantilever spring is attached directly to the second component as a compliant contact interface between the first component and the second component. The cantilever spring provides a radial spring compliance between the first component and the second component. During operation, the cantilever spring directly contacts and supports the first component.

20 Claims, 3 Drawing Sheets

TURBINE COMPONENT ASSEMBLY

FIELD OF THE INVENTION

The present invention is directed to turbine component assemblies. More particularly, the present invention is directed to turbine component assemblies including compliant contact interfaces.

BACKGROUND OF THE INVENTION

Hot gas path components of gas turbines are subjected to high air loads and high acoustic loads during operation which, combined with the elevated temperatures and harsh environments, may damage the components over time. Both metal and ceramic matrix composite ("CMC") components may be vulnerable to such damage, although CMC components are typically regarded as being more susceptible than metallic counterparts, particularly where CMC components are adjacent to metallic components.

Damage from air loads and acoustic loads may be pronounced in certain components, such as turbine shrouds, which include a hot gas path-facing sub-component which is not fully secured to, but in contact with, a non-hot gas path-facing sub-component. By way of example, due to air loads and acoustic loads, the inner shroud of a turbine shroud assembly may vibrate against and be damaged by the outer shroud during operation. Further, loading an inner shroud to dampen air loads and acoustic loads may give rise to thermal binding between the CMC components and metal components, which can further damage the components.

BRIEF DESCRIPTION OF THE INVENTION

In an exemplary embodiment, a turbine component assembly includes a first component, a second component, and a cantilever spring. The first component is arranged to be disposed adjacent to a hot gas path, and includes a CMC composition. The second component is adjacent to the first component and arranged to be disposed distal from the hot gas path across the first component. The cantilever spring is attached directly to the second component as a compliant contact interface between the first component and the second component. The cantilever spring provides a radial spring compliance between the first component and the second component. During operation, the cantilever spring directly contacts and supports the first component.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
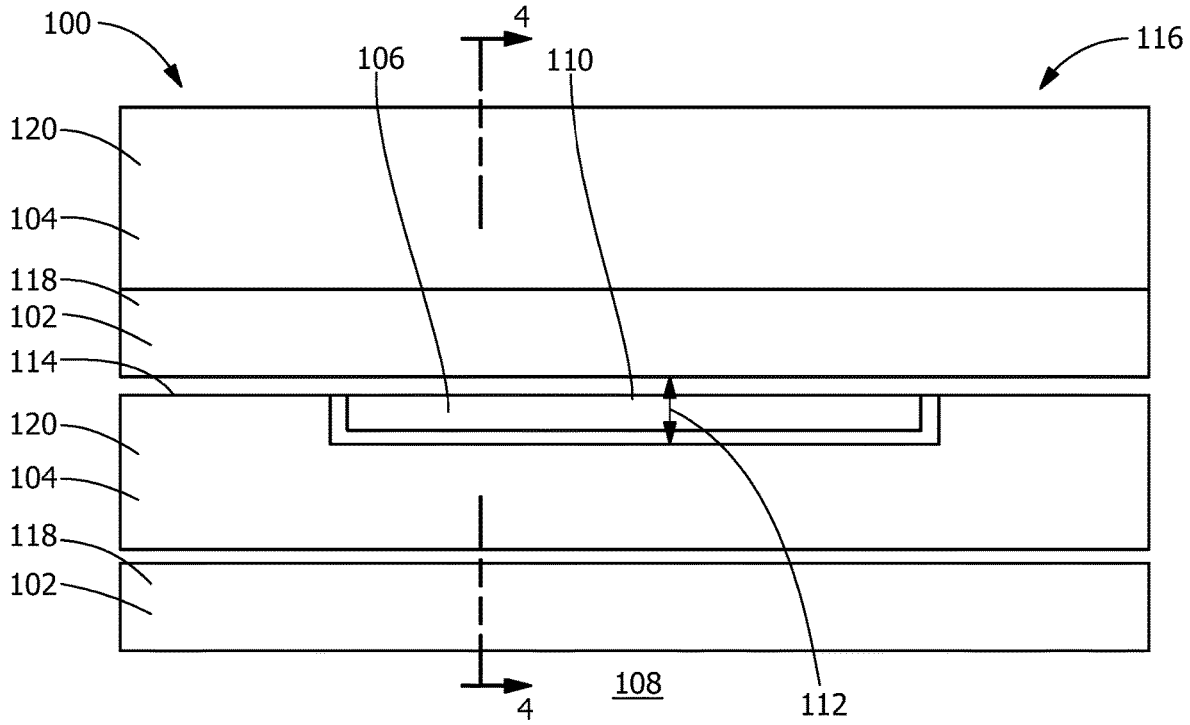
FIG. 1 is a cross-sectional view of a turbine component assembly, according to an embodiment of the present disclosure.

Provided are exemplary turbine component assemblies. Embodiments of the present disclosure, in comparison to articles not utilizing one or more features disclosed herein, decrease costs, improve mechanical properties, increase component life, decrease maintenance requirements, eliminate spring coil failure, reduce or eliminate thermal binding, or combinations thereof.

Referring to FIGS. 1-4, in one embodiment, a turbine component assembly 100 includes a first component 102, a second component 104, and a cantilever spring 106. The first component 102 is arranged to be disposed adjacent to a hot gas path 108, the first component 102 including a CMC composition. The second component 104 is adjacent to the first component 102 and arranged to be disposed distal from the hot gas path 108 across the first component 102. The cantilever spring 106 is attached directly to the second component 104 as a compliant contact interface 110 between the first component 102 and the second component 104. The cantilever spring 106 provides a radial spring compliance 112 between the first component 102 and the second component 104. During operation, the cantilever spring 106 directly contacts and supports the first component 102.

Figure 2:
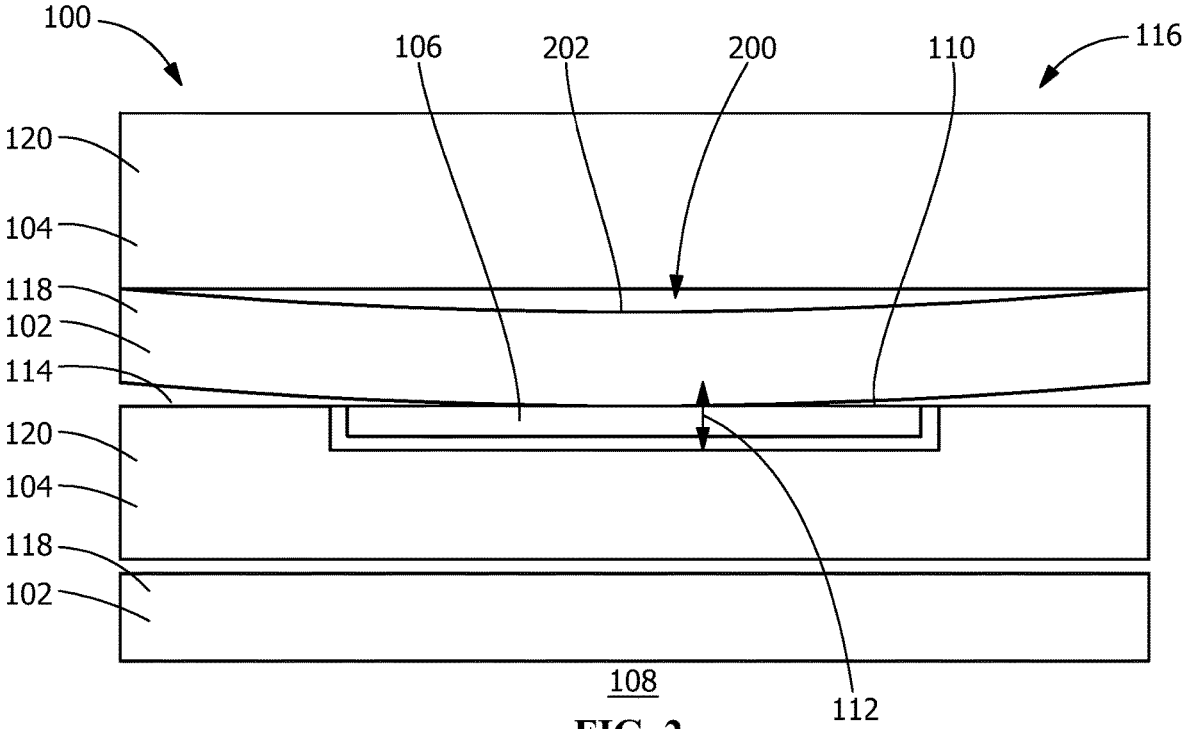
FIG. 2 is a cross-sectional view of the turbine component assembly of FIG. 1 during operation, according to an embodiment of the present disclosure.

Referring to FIGS. 1 and 2, in one embodiment, during operation the first component 102 undergoes a conformation change and deflects to directly contact and exert a mechanical force on the cantilever spring 106. This conformation change is sometimes referred to as "smiling" due to the curvature 200 of the conformation during the deflection of the first component 102, which may be greatest at a midpoint 202 of the first component 102. The deflection of the first component 102 toward the cantilever spring 106 during the smiling may be on the order of about 0.005 inches to about 0.05 inches, and may depend, inter alia, on the operating conditions and an arc length of the first component 102.

The cantilever spring 106 and the second component 104 may be a unitary component of uniform material composition or the cantilever spring 106 may be non-unitary with the second component 104 and may be joined to the second component 104.

In one embodiment, wherein the cantilever spring 106 and the second component 104 are a unitary component of uniform material composition, the cantilever spring 106 is machined from the second component 104. The cantilever spring 106 may be machined by any suitable technique, including, but not limited to, milling, computer numerical control, electrical discharge machining, or combinations thereof. In another embodiment, wherein the cantilever spring 106 and the second component 104 are a unitary component of uniform material composition, the cantilever spring 106 may be formed on the second component 104 by an additive manufacturing technique, such as, but not limited to, electron-beam melting, selective laser melting, selective heat sintering selective laser sintering, direct metal laser sintering, or combinations thereof.

In one embodiment, wherein the cantilever spring 106 is non-unitary with the second component 104 and is joined to the second component 104, the joint may by any suitable joint, including, but not limited to, a braze joint, a weld joint, a bridle joint, a finger joint, a dovetail joint, a dado joint, a groove joint, a mortise and tenon joint, a cross lap joint, a splice joint, a tongue and groove joint, or combinations thereof.

The compliant contact interface 110 between the first component 102 and the second component 104 may include a single cantilever spring 106 or a plurality of cantilever springs 106. In a further embodiment, the compliant contact interface 110 between the first component 102 and the second component 104 consists of the single cantilever spring 106 or the plurality of cantilever springs 106. In one embodiment, the compliant contact interface 110 is free of spring coils, elastomers, and woven metal meshes. The compliant contact interface 110 may load the first component 102 to the second component 104 to a predetermined level during operation.

The first component 102 includes a first coefficient of thermal expansion, and the second component 104 includes a second coefficient of thermal expansion. In one embodiment, wherein the first coefficient of thermal expansion is distinct from the second coefficient of thermal expansion, the turbine component assembly 100 includes a coefficient of thermal expansion variance. In a further embodiment, the first coefficient of thermal expansion is lower than the second coefficient of thermal expansion, and the first component 102 undergoes smiling during operating conditions such as startup and steady state where the first component 102 is exposed to higher temperatures than the second component 104. The deflection of the first component 102 toward the cantilever spring 106 during the smiling may be on the order of about 0.005 inches to about 0.05 inches, and may depend, inter alia, on the operating conditions and an arc length of the first component 102.

In one embodiment, the compliant contact interface 110 reduces thermal binding under operating conditions relative to a comparative assembly not including the compliant contact interface 110. In another embodiment, the compliant contact interface 110 reduces wear of the first component 102 under operating conditions relative to a comparative assembly not including the compliant contact interface 110.

The cantilever spring 106 may be positioned such that the compliant contact interface 110 is raised relative to an adjacent surface 114 of the second component 104, is depressed relative to the adjacent surface 114 of the second component 104, or is flush relative to the adjacent surface 114 of the second component 104.

The first component 102 may include any suitable CMC composition, including, but not limited to, CMCs, aluminum oxide-fiber-reinforced aluminum oxides (Ox/Ox), carbon-fiber-reinforced carbon (C/C), carbon-fiber-reinforced silicon carbides (C/SiC), silicon-carbide-fiber-reinforced silicon carbides (SiC/SiC), carbon-fiber-reinforced silicon nitrides ($C/Si_3N_4$), silicon-carbide-fiber-reinforced silicon nitrides ($SiC/Si_3N_4$) or combinations thereof.

The second component 104 may include any suitable composition, including, but not limited to, a metallic composition. Suitable metallic compositions may include, but are not limited to, iron alloys, steels, stainless steels, carbon steels, nickel alloys, superalloys, nickel-based superalloys, INCONEL 718, INCONEL 738, INCONEL X-750, Rene 41, cobalt-based superalloys, cobalt L-605, or combinations thereof.

The cantilever spring 106 may include any suitable composition, including, but not limited to, a metallic composition. Suitable metallic compositions may include, but are not limited to, superalloys, nickel-based superalloys, cobalt-based superalloys, INCONEL 718, INCONEL X-750, Rene 41, cobalt L-605, or combinations thereof.

In one embodiment, the cantilever spring 106 includes a hard wear surface coating disposed such that the compliant contact interface 110 includes the hard wear surface coating. The hard wear surface coating may include any suitable coating composition, including, but not limited to, STELLITE 720 ULTRAFLEX, STELLITE 6, STELLITE 6B, STELLITE 6K, STELLITE 21, TRIBALLOY T-400, TRIBALLOY T-400C, TRIBALLOY T-800, X-40, X-45, FSX-414, copper alloys, MONEL alloys, MONEL 400, MONEL 401, MONEL 404, MONEL K-500, MONEL 405, aluminum bronzes, INCONEL 625, INCONEL 718, INCONEL 738, or combinations thereof.

As used herein, "cobalt L-605" refers to an alloy including a composition, by weight, of about 20% chromium, about 10% nickel, about 15% tungsten, about 0.1% carbon, about 1.5% manganese, and a balance of cobalt. Cobalt L-605 is available from Special Metals Corporation, 3200 Riverside Drive, Huntington, W. Va. 25720.

As used herein, "FSX-414" refers to an alloy including a composition, by weight, of about 29% chromium, about 7% tungsten, about 10% nickel, about 0.6% carbon, and a balance of cobalt. FSX-414 is commercially available under that designation As used herein, "INCONEL 625" refers to an alloy including a composition, by weight, of about 21.5% chromium, about 5% iron, about 9% molybdenum, about 3.65% niobium, about 1% cobalt, about 0.5% manganese, about 0.4% aluminum, about 0.4% titanium, about 0.5% silicon, about 0.1% carbon, and a balance of nickel. INCONEL 625 is available from Special Metals Corporation, 3200 Riverside Drive, Huntington, W. Va. 25720.

As used herein, "INCONEL 718" refers to an alloy including a composition, by weight, of about 19% chromium, about 18.5% iron, about 3% molybdenum, about 3.6% niobium and tantalum, and a balance of nickel. INCONEL 718 is available from Special Metals Corporation, 3200 Riverside Drive, Huntington, W. Va. 25720.

As used herein, "INCONEL 738" refers to an alloy including a composition, by weight, of about 0.17% carbon, about 16% chromium, about 8.5% cobalt, about 1.75% molybdenum, about 2.6% tungsten, about 3.4% titanium, about 3.4% aluminum, about 0.1% zirconium, about 2% niobium, and a balance of nickel. INCONEL 738 is available from Special Metals Corporation, 3200 Riverside Drive, Huntington, W. Va. 25720.

As used herein, "INCONEL X-750" refers to an alloy including a composition, by weight, of about 15.5% chromium, about 7% iron, about 2.5% titanium, about 0.7% aluminum, and about 0.5% niobium and tantalum, and a balance of nickel. INCONEL X-750 is available from Special Metals Corporation, 3200 Riverside Drive, Huntington, W. Va. 25720.

As used herein, "MONEL 400" refers to an alloy including a composition, by weight, of at least about 63% nickel, up to about 2.5% iron, up to about 2% manganese, up to about 0.5% silicon, and a balance of copper. MONEL 400 is available from Special Metals Corporation, 3200 Riverside Drive, Huntington, W. Va. 25720.

As used herein, "MONEL 401" refers to an alloy including a composition, by weight, of at least about 63% nickel, up to about 2.5% iron, up to about 2% manganese, and a balance of copper. MONEL 401 is available from Special Metals Corporation, 3200 Riverside Drive, Huntington, W. Va. 25720.

As used herein, "MONEL 404" refers to an alloy including a composition, by weight, of about 54.5% nickel, up to about 0.5% iron, up to about 0.1% manganese, up to about 0.1% silicon, up to about 0.05% aluminum, and a balance of copper. MONEL 404 is available from Special Metals Corporation, 3200 Riverside Drive, Huntington, W. Va. 25720.

As used herein, "MONEL K-500" refers to an alloy including a composition, by weight, of at least about 63% nickel, up to about 2% iron, up to about 1.5% manganese, up to about 0.5% silicon, about 2.75% aluminum, about 0.6% titanium, and a balance of copper. MONEL K-500 is available from Special Metals Corporation, 3200 Riverside Drive, Huntington, W. Va. 25720.

As used herein, "MONEL 405" refers to an alloy including a composition, by weight, of at least about 63% nickel, up to about 2.5% iron, up to about 2% manganese, up to about 0.5% silicon, up to about 0.05% aluminum, and a balance of copper. MONEL 405 is available from Special Metals Corporation, 3200 Riverside Drive, Huntington, W. Va. 25720.

As used herein, "Rene 41" refers to an alloy including a composition, by weight, of about 19% chromium, about 11% cobalt, about 10% molybdenum, about 1.5% aluminum, about 3.1% titanium, and a balance of nickel. Rene 41 is commercially available under that designation.

As used herein "STELLITE 6" refers to an alloy including, by weight, about 30% chromium, about 4.5% tungsten, about 1.2% carbon, and a balance of cobalt. STELLITE 21 ULTRAFLEX is available from Deloro Wear Solutions GmbH, Zur Bergpflege 51-53, 56070 Koblenz, Germany.

As used herein "STELLITE 6B" refers to an alloy including, by weight, about 29% chromium, about 4.5% tungsten, about 1.2% carbon, and a balance of cobalt. STELLITE 21 ULTRAFLEX is available from Deloro Wear Solutions GmbH, Zur Bergpflege 51-53, 56070 Koblenz, Germany.

As used herein "STELLITE 6K" refers to an alloy including, by weight, about 30% chromium, about 4.5% tungsten, about 1.7% carbon, and a balance of cobalt. STELLITE 21 ULTRAFLEX is available from Deloro Wear Solutions GmbH, Zur Bergpflege 51-53, 56070 Koblenz, Germany.

As used herein "STELLITE 21" refers to an alloy including, by weight, about 28% chromium, about 3% nickel, about 5.2% molybdenum, about 0.25% carbon, and a balance of cobalt. STELLITE 21 ULTRAFLEX is available from Deloro Wear Solutions GmbH, Zur Bergpflege 51-53, 56070 Koblenz, Germany.

As used herein "STELLITE 720 ULTRAFLEX" refers to an alloy including, by weight, about 33% chromium, about 2.45% carbon, about 18% molybdenum, about 0.5% silicon, and a balance of cobalt. STELLITE 720 ULTRAFLEX is available from Deloro Wear Solutions GmbH, Zur Bergpflege 51-53, 56070 Koblenz, Germany.

As used herein, "TRIBALOY T-400" refers to an alloy including a composition, by weight, of about 8.5% chromium, about 28% molybdenum, about 2.5% silicon, and a balance of cobalt. TRIBALOY T-800 is available from Kennametal Inc., 1662 MacMillan Park Drive, Fort Mill, S.C. 29707.

As used herein, "TRIBALOY T-400C" refers to an alloy including a composition, by weight, of about 14% chromium, about 27% molybdenum, about 2.6% silicon, and a balance of cobalt. TRIBALOY T-800 is available from Kennametal Inc., 1662 MacMillan Park Drive, Fort Mill, S.C. 29707.

As used herein, "TRIBALOY T-800" refers to an alloy including a composition, by weight, of about 18% chromium, about 28% molybdenum, about 3.4% silicon, and a balance of cobalt. TRIBALOY T-800 is available from Kennametal Inc., 1662 MacMillan Park Drive, Fort Mill, S.C. 29707.

As used herein, "X-40" refers to an alloy including a composition, by weight, of about 10% nickel, about 25% chromium, about 7.5% tungsten, about 0.45% carbon, and a balance of cobalt. X-40 is commercially available under that designation.

As used herein, "X-45" refers to an alloy including a composition, by weight, of about 10% nickel, about 25% chromium, about 7.5% tungsten, about 0.5% manganese, about 0.9% silicon, and a balance of cobalt. X-45 is commercially available under that designation.

Figure 3:
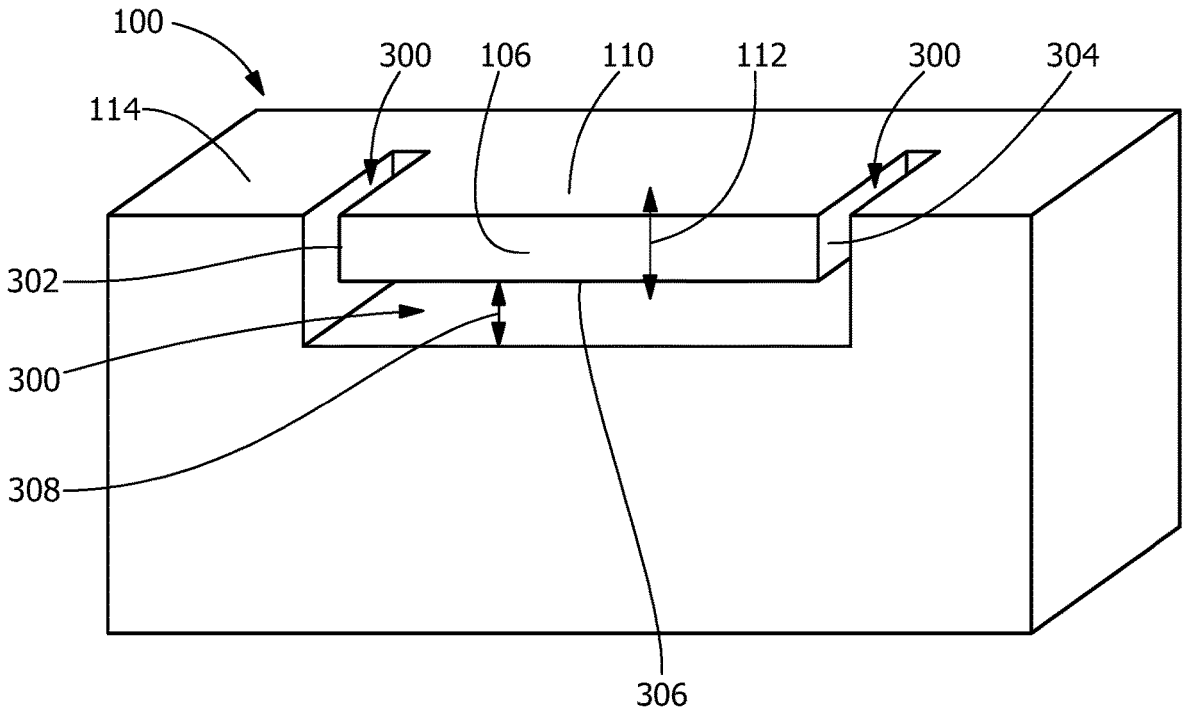
FIG. 3 is a perspective view of the cantilever spring of FIG. 1, according to an embodiment of the present disclosure.

Referring to FIG. 3, in one embodiment, the second component 104 includes a relief 300. The relief 300 forms a first end 302 of the cantilever spring 106, a second end 304 of the cantilever spring 106, a radial flexion side 306 of the cantilever spring 106 opposite to the compliant contact interface 110, and a radial flexion clearance 308 for the cantilever spring 106. The radial flexion clearance 308 is sufficient to provide the radial spring compliance 112. Without being bound by theory, it is believed that the fulcrum length and thickness of the cantilever spring 106, along with the material composition of the cantilever spring 106, primarily determine the stiffness or spring factor provided by the cantilever spring 106.

Figure 4:
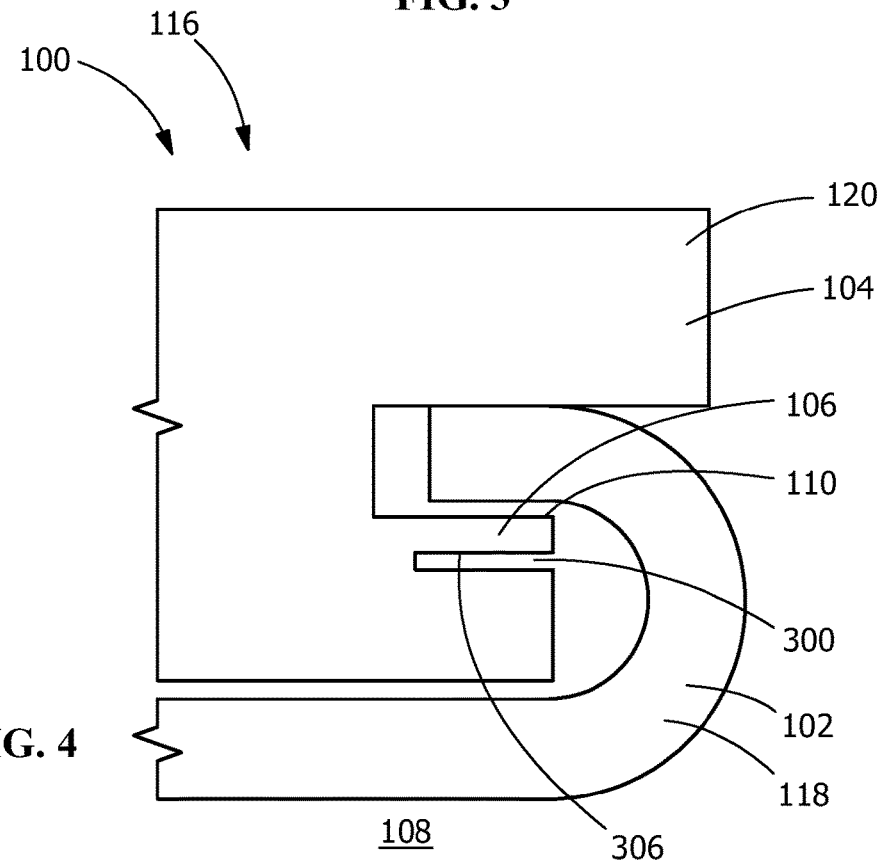
FIG. 4 is a perpendicular cross-section view along lines 4-4 of the turbine component assembly of FIG. 1, according to an embodiment of the present disclosure.
Figure 5:
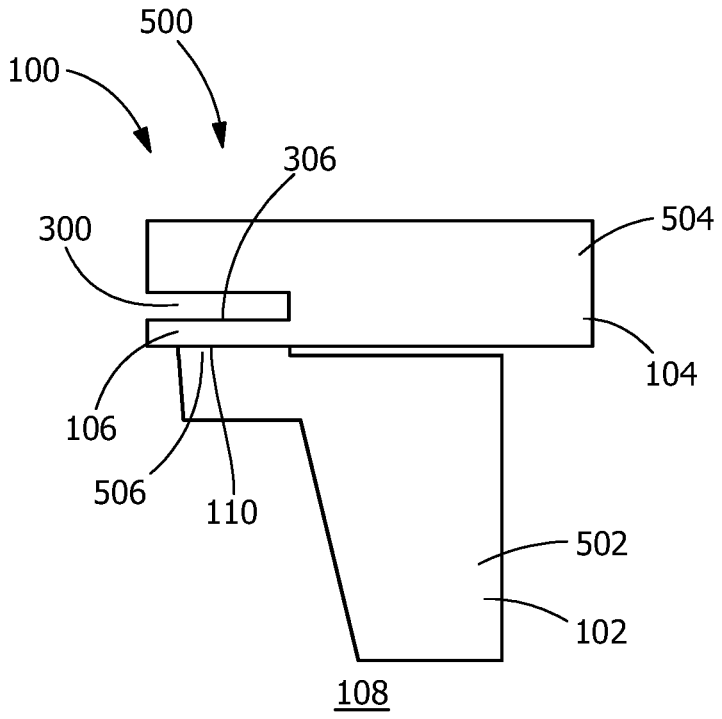
FIG. 5 is a cross-sectional view of a turbine component assembly wherein the turbine component assembly is a nozzle assembly, according to an embodiment of the present disclosure.

Referring to FIGS. 1, 4, and 5, the turbine component assembly 100 may be any suitable apparatus, including, but not limited to, a shroud assembly 116 (FIGS. 1 and 4) wherein the first component 102 is an inner shroud 118 and the second component 104 is an outer shroud 120, a nozzle assembly 500 (FIG. 5) wherein the first component 102 is a nozzle end wall 502 and the second component 104 is a nozzle outer wall 504, a combustor (not shown) wherein the first component 102 is a combustor liner and the second component 104 is a combustor case, or a combustor tile (not shown) wherein the first component 102 is a combustion chamber-facing portion and the second component 104 is a combustor case-facing portion.

Referring to FIG. 5, in one embodiment, wherein the first component 102 is a nozzle end wall 502 and the second component 104 is a nozzle outer wall 504, the nozzle end wall 502 may include a contact extension 506 which contacts the nozzle outer wall 504 and supports the nozzle end wall 502 under non-operational conditions.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine shroud assembly, comprising:

an inner shroud arranged to be disposed adjacent to a hot gas path, the inner shroud including a ceramic matrix composite (CMC) composition;

an outer shroud adjacent to the inner shroud and arranged to be disposed distal from the hot gas path across the inner; and a cantilever spring attached directly to the outer shroud at a first end of the cantilever spring as a compliant contact interface between the inner shroud and the outer shroud, a second end of the cantilever spring opposite the first end of the cantilever spring being free, the cantilever spring providing a radial spring compliance between the inner shroud and the outer shroud, wherein a portion of the inner shroud curves from adjacent to the hot gas path around a portion of the outer shroud and into a gap between a first surface of the outer shroud and a second surface of the outer shroud, mounting the inner shroud to the outer shroud, the gap being distal from the hot gas path across the portion of the outer shroud, wherein the cantilever spring forms a portion of the second surface of the outer shroud, and wherein, during operation, the cantilever spring directly contacts and supports the inner shroud within the gap.

2. The turbine shroud assembly of claim 1, wherein, during operation, the inner shroud undergoes a conformation change, deflecting to directly contact and exert a mechanical force on the cantilever spring.

3. The turbine shroud assembly of claim 1, wherein the cantilever spring and the outer shroud are a unitary component of uniform material composition.

4. The turbine shroud assembly of claim 1, wherein the cantilever spring is machined from the outer shroud.

5. The turbine shroud assembly of claim 1, wherein the cantilever spring is non-unitary with the outer shroud and is joined to the outer shroud by a joint selected from the group consisting of a braze joint, a weld joint, a bridle joint, a finger joint, a dovetail joint, a dado joint, a groove joint, a mortise and tenon joint, a cross lap joint, a splice joint, a tongue and groove joint, and combinations thereof.

6. The turbine shroud assembly of claim 1, wherein the outer shroud includes a relief, the relief forming a third end of the cantilever spring, a fourth end of the cantilever spring, a radial flexion side of the cantilever spring opposite to the compliant contact interface, and a radial flexion clearance for the cantilever spring.

7. The turbine shroud assembly of claim 1, wherein the compliant contact interface is flush relative to an adjacent portion of the second surface of the outer shroud.

8. The turbine shroud assembly of claim 1, further including a coefficient of thermal expansion variance between the inner shroud and the outer shroud.

9. The turbine shroud assembly of claim 1, wherein the compliant contact interface between the inner shroud and the outer shroud consists of the cantilever spring.

10. The turbine shroud assembly of claim 1, wherein the compliant contact interface between the inner shroud and the outer shroud includes a plurality of the cantilever spring.

11. The turbine shroud assembly of claim 1, wherein the outer shroud is metallic.

12. The turbine shroud assembly of claim 1, wherein the compliant contact interface reduces thermal binding relative to a comparative assembly not including the compliant contact interface.

13. The turbine shroud assembly of claim 1, wherein the compliant contact interface reduces wear of the inner shroud relative to a comparative assembly not including the compliant contact interface.

14. The turbine shroud assembly of claim 1, wherein the compliant contact interface loads the inner shroud to the outer shroud to a predetermined level during operation.

15. The turbine shroud assembly of claim 1, wherein the compliant contact interface includes a hard wear surface coating.

16. The turbine shroud assembly of claim 15, wherein the hard wear surface coating is selected from the group consisting of STELLITE 720 ULTRAFLEX, STELLITE 6, STELLITE 6B, STELLITE 6K, STELLITE 21, TRIBALLOY T-400, TRIBALLOY T-400C, TRIBALLOY T-800, X-40, X-45, FSX-414, copper alloys, MONEL alloys, MONEL 400, MONEL 401, MONEL 404, MONEL K-500, MONEL 405, aluminum bronzes, INCONEL 625, INCONEL 718, INCONEL 738, and combinations thereof.

17. The turbine shroud assembly of claim 1, wherein the compliant contact interface is free of spring coils, elastomers, and woven metal meshes.

18. The turbine shroud assembly of claim 1, wherein the second surface is proximal to the hot gas path and the first surface is distal to the hot gas path across the gap.

19. The turbine shroud assembly of claim 18, wherein the inner shroud is disposed in contact with the first surface.

20. The turbine shroud assembly of claim 19, wherein, during operation, the inner shroud undergoes a conformation change, remaining in contact with the first surface while deflecting at a midpoint to contact the cantilever spring.

* * * * *